United States Patent [19]

Wilson

[11] 4,193,282

[45] Mar. 18, 1980

[54] ROLLING MACHINE

[75] Inventor: Alexander I. Wilson, Sheffield, England

[73] Assignee: Hill Engineering Company Limited, Sheffield, England

[21] Appl. No.: 921,766

[22] Filed: Jul. 3, 1978

[51] Int. Cl.[2] ..... B21B 13/20

[52] U.S. Cl. ..... 72/194; 72/191; 72/197

[58] Field of Search ..... 72/187, 190, 191, 194, 72/197, 198, 235, 240

[56] References Cited

U.S. PATENT DOCUMENTS

| | | | |
|---|---|---|---|
| 1,622,744 | 3/1927 | Stiefel | 72/190 |
| 3,643,488 | 2/1972 | Bretschneider | 72/191 |

FOREIGN PATENT DOCUMENTS

| | | | |
|---|---|---|---|
| 1816915 | 7/1970 | Fed. Rep. of Germany | 72/191 |

*Primary Examiner*—Lowell A. Larson
*Attorney, Agent, or Firm*—Brisebois & Kruger

[57] ABSTRACT

A rolling machine for reducing the cross-sectional dimensions of an elongate workpiece, such as a steel billet, has two pairs of alternately operating rolls, each of which is journalled in an individual roll carrier. Each carrier is rotated about a carrier axis which is inclined at an angle of about 45° to the axis of rotation of the roll journalled in the carrier. The carrier axes form the sides of a square around the passline which is normal to the plane in which the carrier axes are located. As the carriers rotate the two pairs of rolls alternately sweep over the workpiece and intermittently contact and reduce the workpiece in directions which are mutually at right angles. To avoid the formation of sharp edges to the rolled workpiece, either each roll is collared to enclose a workpiece edge, or each carrier additionally carries an edger roll which rounds that edge.

21 Claims, 8 Drawing Figures

ROLLING MACHINE

This invention relates to a rolling machine for reducing the cross-sectional dimensions of an elongate workpiece by successive intermittent engagements of pairs of rolls with the workpiece. The workpiece is metallic particularly but not exclusively steel.

Figure 2:
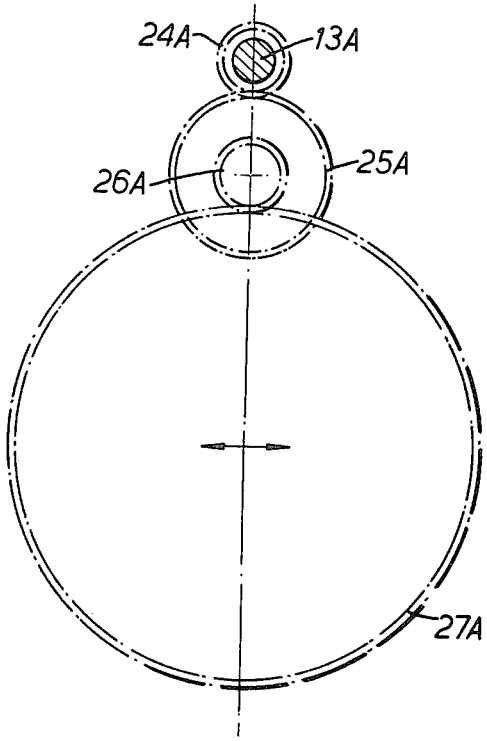

FIG. 2 of U.K. patent No. 1,214,905 describes such a rolling machine having a first pair of cooperating freely rotatable rolls between which the workpiece is to be intermittently reduced in a first reduction direction and a second pair of similar cooperating rolls between the workpiece is to be intermittently reduced at right angles to the first reduction direction. Each roll is carried in a bearing which is eccentrically mounted on a driven shaft. The axis of rotation of each roll and its eccentric shaft are parallel. The four eccentric shafts are driven synchronously, whereby in each cycle the rolls of each pair of rolls approach and recede from the passline and each other as the rolls move in the passline direction and the workpiece is intermittently contacted and reduced by the pairs of rolls alternatively.

When rolling rod or bar from billet, using the rolling machine described in specification No. 1,214,905 in relation to FIG. 2, the two pairs of rolls alternately roll the workpiece on mutually perpendicular planar faces, with the result that the rolled product has sharp lengthwise edges which are considered to be megallurgically unsound.

It is an object of the present invention to provide a rolling machine design which is capable of rolling sections with rounded edges.

It is another object of the invention to use rolls, each of which has a rolling surface which encompasses an edge of the workpiece in order to round that edge.

A rolling machine for reducing the cross-sectional dimensions of an elongate workpiece movable along a passline comprises:

(a) a first pair of cooperating rolls between which said workpiece is to be intermittently reduced in a first reduction direction;

(b) a second pair of cooperating rolls between which said workpiece is intermittently reduced in a second reduction direction transverse to said first direction;

(c) for each said roll of said first and second pairs, a carrier in which said roll is journalled for rotation about the roll axis and which is mounted for rotation about a carrier axis inclined to said roll axis;

(d) the carrier axes of said carriers for said first pair of rolls being transverse to said passline and on opposite sides thereof;

(e) the carrier axes of said carriers for said second pair of rolls being transverse both to said passline and to said carrier axes of said carriers for said first pair of rolls and lying on opposite sides of said passline; and (f) means for synchronously driving all said carriers about said carrier axes;

(g) whereby in each cycle said rolls of each said pair of rolls approach and recede from said passline and each other as said rolls move in the direction of said passline, and said workpiece is intermittently contacted and reduced by said pairs of rolls alternately.

In a preferred form of the invention, each roll has a collar with a rolling face designed to enclose and round an edge of a rhombic-section workpiece. The invention is not however limited to such an arrangement, since the rounding of the edge may be effected by a separate edge roller carried by the roll carrier and following the main roll. Again, each roll may be designed to roll a curved face of the workpiece with the aim of producing a round section.

Figure 1:
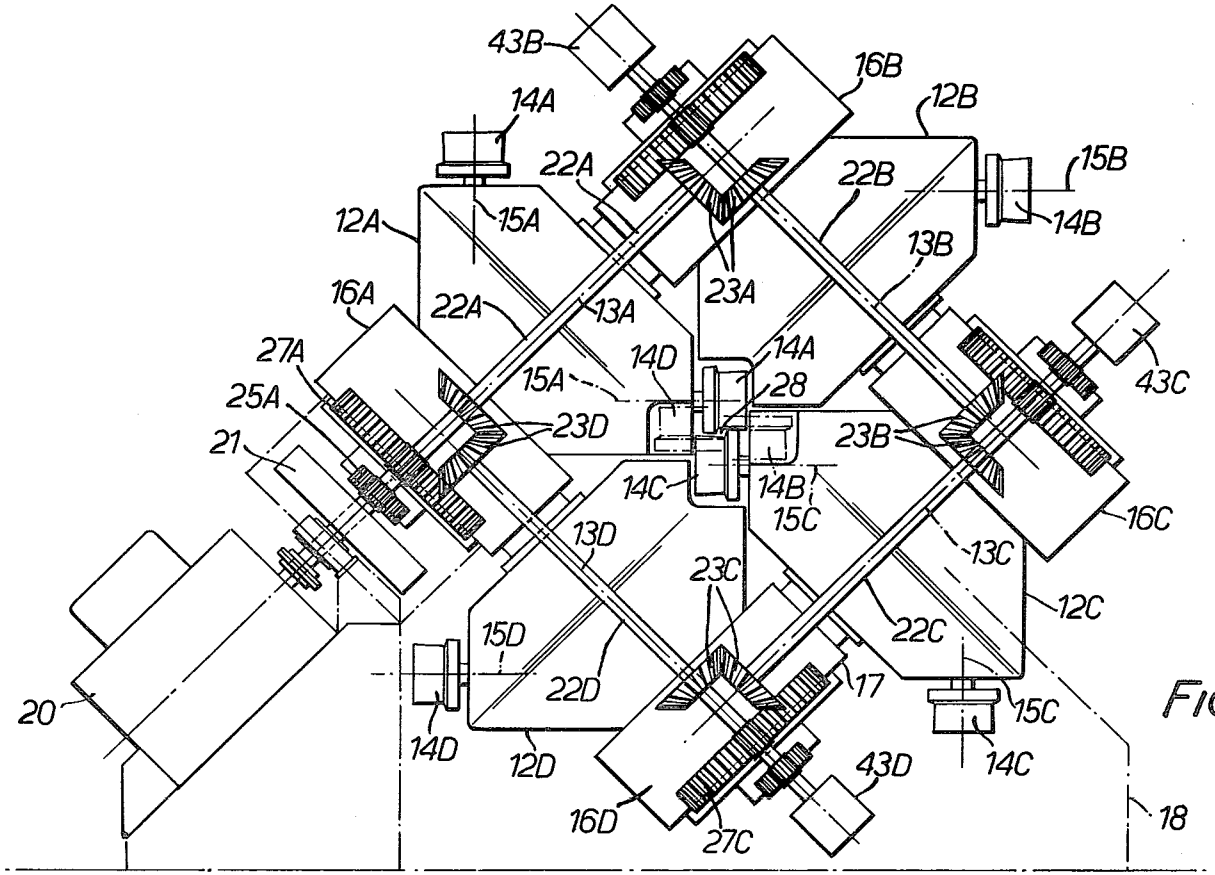
Figure 8:
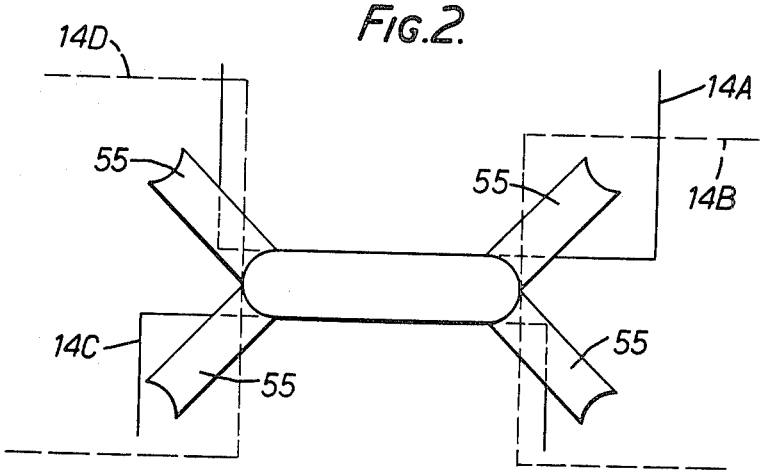
Figure 3:
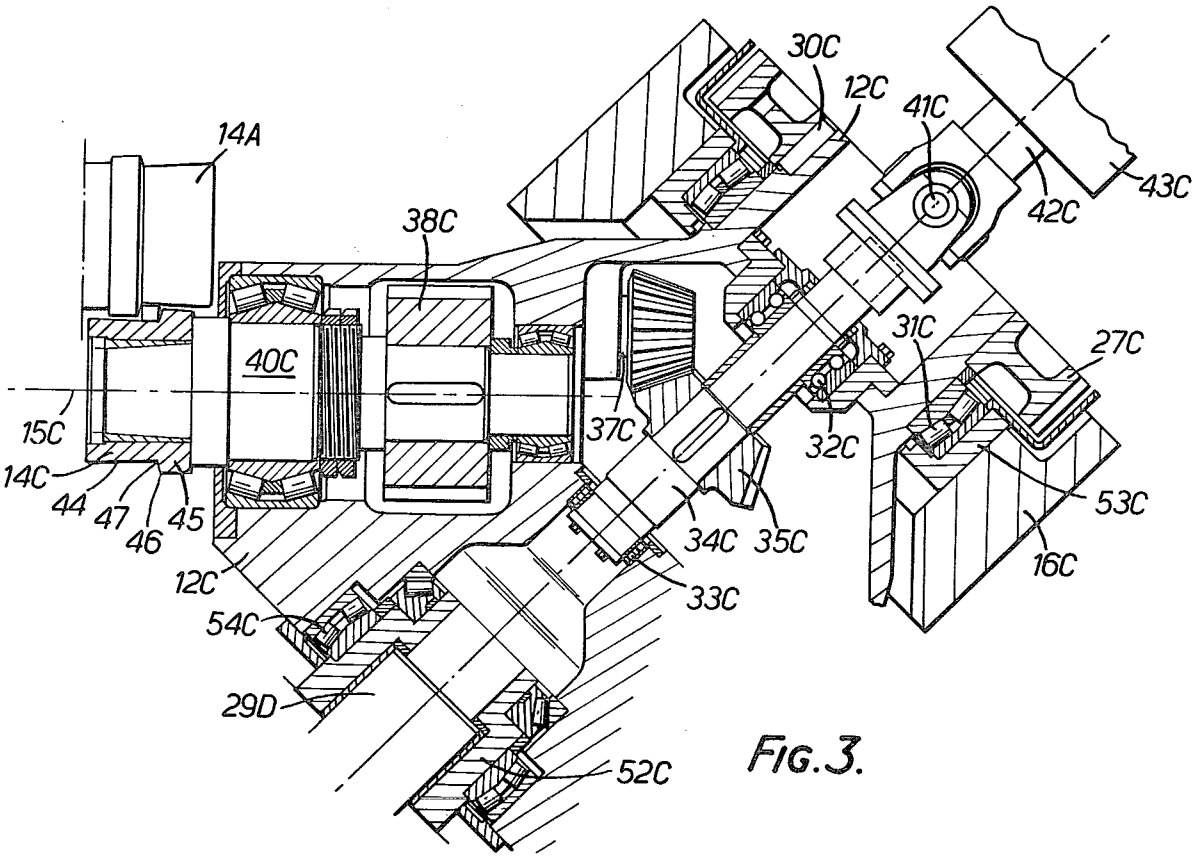
Figure 4:
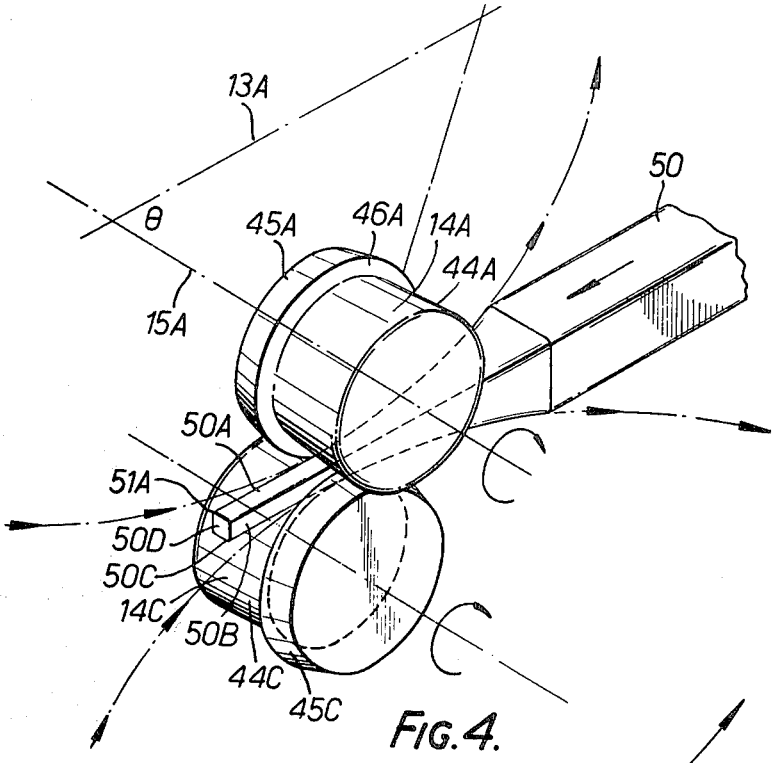
Figure 5:
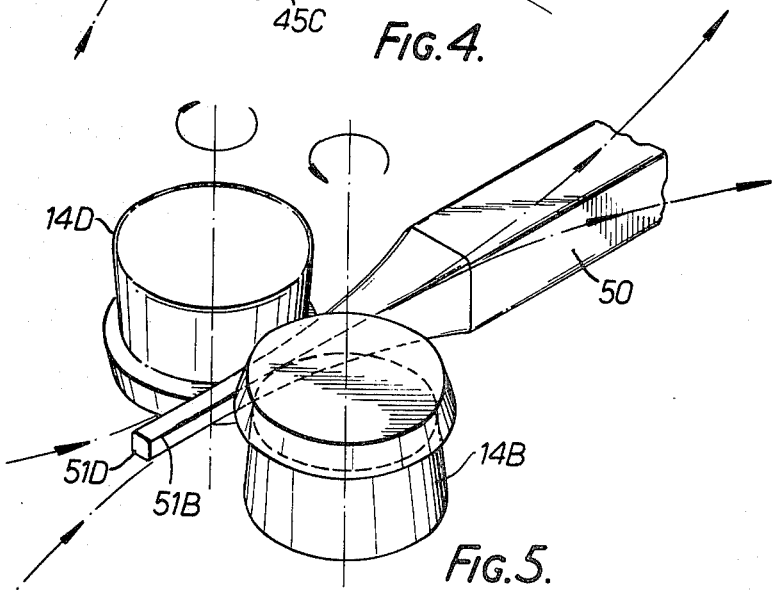
Figure 6:
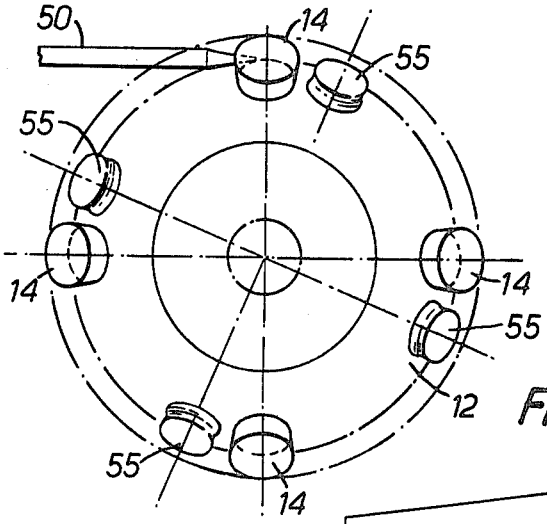
Figure 7:
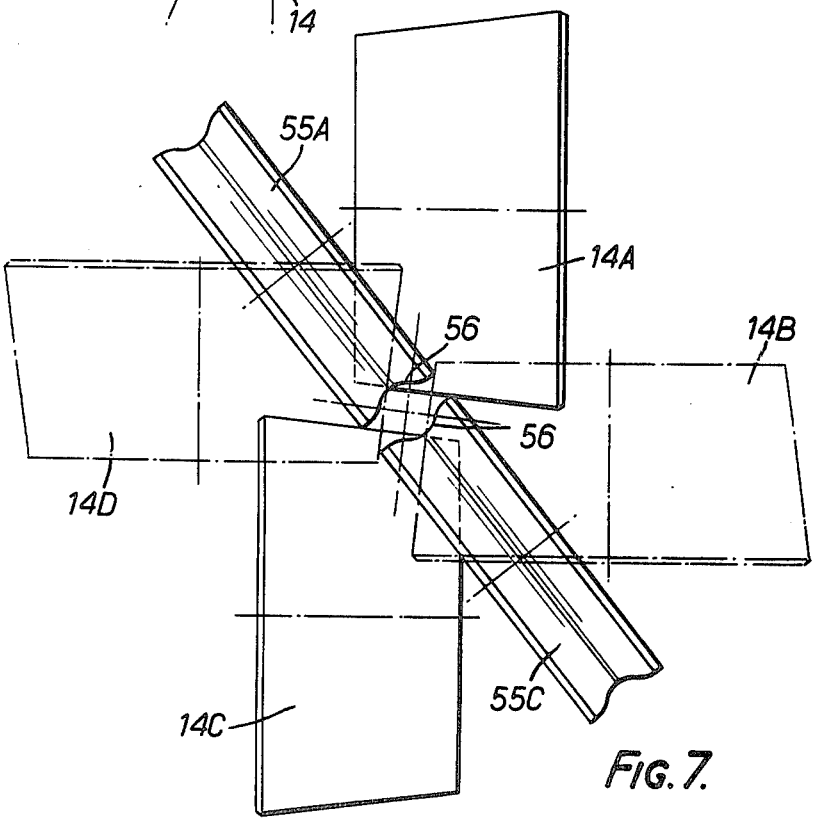

The invention is exemplified by the following description of a preferred form of rolling machine according to the invention, reference being made to the accompanying drawings, in which FIG. 1 is a side view of the rolling machine, FIG. 2 schematically illustrates the drive to one of the roll carriers, FIG. 3 is a partial axial section through one of the roll carriers, FIGS. 4 and 5 are perspective views illustrating the rolling section, FIGS. 6 and 7 illustrate a modification employing uncollared rolls, FIG. 6 being an end view of a roll carrier and FIG. 7 shows the rolls at the passline, and FIG. 8 illustrates the rolling of a flat.

The rolling machine illustrated in FIGS. 1 to 5 consists basically of four roll carriers 12A, 12B, 12C and 12D, each of which has the general form of a cone. The four roll carriers are identical in construction and the parts thereof are given the same reference numerals with the letter A, B, C or D identifying the carrier to which it belongs. The roll carriers rotate about axes 13A–13D which are also the axes of the cones and which form the sides of a square. Each roll carrier 12 carries at least one roll 14 (in the drawings four rolls are shown) which is independently driven about a roll axis 15 inclined to the carrier axis 13. Where, as shown, each carrier has more than one roll 14, the roll axes 15 are equally angularly spaced about the carrier axis 13.

The four carriers 12 are mounted in bearings in four bearing blocks 16, the carrier 12A for example being journalled in bearings in blocks 16A and 16B and the carrier 12B in bearings in blocks 16B and 16C. The four bearing blocks are secured in a frame constituted by two spaced rectilinear frame members 17 welded on opposite sides of the blocks 16 and supported by uprights 18.

The roll carriers 12 are driven synchronously about their axes 13. Thus, FIG. 1 shows a common drive motor 20 carried by the uprights 18 and driving through a flywheel 21 four line shafts 22A–22D. The shafts 22 are on the face of the frame, being displaced from the axes 13, and are geared together through bevel gears 23A–23D. Each shaft 22 is geared to the corresponding roll carrier 12 through reduction gearing shown in FIG. 1 and schematically in FIG. 2; thus shaft 13A carries a pinion 24A meshing with a larger pinion 25A which is shaft-connected to a pinion 26A meshing with a large pinion 27A fast on the roll carrier 12A. By virtue of the drive, the four roll carriers are driven at the same rotational speed. The pair of roll carriers 12A and 12C rotate in phase so that the rolls 14A and 14C reach the passline 28, which is normal to the plane containing the carrier axes 13, at the same time as shown in FIG. 1. The other pair of carriers 12B and 12D similarly rotate in phase, but are displaced in phase relative to carriers 12A and 12C so that successive pairs of rolls 14A and 14C alternate at the passline 28 with successive pairs of rolls 14B and 14D.

FIG. 3 shows partially one of the roll carrier (12C) in greater detail and particularly and drive to the rolls 14C of that carrier. The figure shows the pinion 27C as a ring gear which lies partly within the bearing block 16C and which is splined to carrier 12C by a spline 30C. The carrier 12C is journalled at one end in bearings 31C carried by the block 16C at the other end on a stud shaft 29D extending from block 16D. The carrier supports in two spaced aligned bearings 32C and 33C a roll drive shaft 34C which is coaxial with the carrier axis 31C. Shaft 34C has splined to it a bevel gear 35C which meshes with four driven bevel gears 36C, one only of which is shown in the figure, fast on shafts 37C journalled in the carrier. Each shaft 37C carries pinion (not shown) meshing with a gear 38C splined to a roll shaft 40C which is journalledin the carrier and to the end of which is secured one of the rolls 14C.

The roll drive shaft 34C has one end attached through a universal coupling 41C to a connecting shaft 42C of an individual drive motor 43C. The other end is carried in a bearing (not shown) in the block 16D. As the roll drive shaft 34C rotates, it drives through bevel gears 35C and 36C the four roll shafts 40C of the roll carrier 12C and hence the four rolls 14C. At the same time the roll carrier 12C is rotated about its axis 13C by the motor 20 through the gear train described above.

As is clear from FIG. 3, the axis 15C of each roll shaft 40C is inclined to the carrier axis 13C at an angle which is the same for all roll shafts 40 and which is slightly greater than 45°. In addition, the four roll axes 15 in each roll carrier 12 intersect the axis 13 of that carrier at the same intersection point. As illustrated in FIGS. 1 and 3, each roll 14 has a frusto-conical face 44 the generator of which passes through the axes intersection point of the carrier. At its inboard end, each roll has a collar 45 on which is formed an annular face 46 which is transverse to the roll axis 15 and which is rounded at 47 so as to merge smoothly with the face 44.

The operation of the rolling machine to roll down a square section steel billet to a bar will now be described in relation to FIGS. 4 and 5. In those figures, the workpiece—the billet to be reduced to bar—is indicated at 50. Pinch rolls (not shown) urges the workpiece along the passline 28 in the direction indicated at a slow continuous speed. The rolls 14 of each roll carrier 12 are caused to swing successively in contact with one of the faces 50A, 50B, 50C or 50D, moving while in contact in a direction opposite to the movement of the workpiece. At the same time each roll is rotated about its own axis in a direction as indicated urging the workpiece in its direction of movement.

Because the rolls of opposite roll carriers (12A, 12C or 12B, 12D) move in phase as described above, one roll 14A and one roll 14C reach the passline together and cooperate to reduce between them the forward end of the workpiece 50, rolling on the faces 50A and 50C. The axis 15 of each roll follows the surface of a cone as the respective carrier 12 rotates about its axis 13 so that the roll follows a circular path, first contacting the reduced work at a minimum separation from its cooperating roll and the lengthwise axis of the work and then swinging away from the lengthwise workpiece axis until the face 44A breaks contact with the workpiece at its maximum dimension. At the same time, and because the carrier axis 13 is inclined to the roll axis, the collars 45 of the two rolls swing away from each other.

The sequence of intermittent reductions performed by the rolls is as follows.

1. Assuming the workpiece is partially reduced as shown in FIGS. 4 and 5, a pair of cooperating rolls 14A and 14C of carriers 12A and 12C engage the workpiece at its reduced dimension and as they roll up the faces 50A and 50C, the roll faces 44A and 44C perform an incremental reduction of those workpiece faces.
2. Simultaneously the faces 46 of the rolls 14A and 14C roll the edges 51A, 51C of the workpiece with the result that parts 47 of the roll faces round these edges.
3. The pair of rolls 14A, 14C is succeeded by a pair of rolls 14B, 14D (FIG. 5) of carriers 12B, 12D which operate in the same manner on the workpiece but on faces 50B, 50D at right angles to face 50A and 50C, the edges 51B and 51D being rounded by the collars 45B, 45D. Because of the inclination of the roll axes to the carrier axes, the roll faces 46B, 46D follow the divergent workpiece faces 50A, 50B formed on the workpiece by previous rolling operations of the rolls of carriers 12A, 12C. The rolls 14B, 14D break contact with the workpiece 50 at a point displaced in the direction opposite to the workpiece movement from where the previously acting rolls 14A, 14C had broken contact, by a distance dependent on the forward movement of the workpiece between successive rolling operations.
4. The pair of rolls 14B, 14D are in turn succeeded by the next pair of rolls 14A, 14C of the carriers 12A, 12C and, as before, the latter rolls performs a further incremental reduction of faces 50A, 50C.

The workpiece 50 is thus given incremental reductions on alternate pairs of faces 50A, 50C and 50B, 50D, the edges 51 of the workpiece being rounded after each incremental reduction, and the workpiece is progressively reduced to a bar having a square cross-section but with rounded lengthwise edges and with cross-sectional dimensions substantially less than those of the unrolled billet.

In order that the dimensions of the rolled bar may be adjusted, each of the roll carriers 12 is eccentrically mounted; thus bearing 31C (FIG. 3) is carried by a ring 53 which is eccentrically mounted in the block 16C and the other bearing 54 for the carrier is similarly mounted on an eccentric sleeve 52 located on stub shaft 29. By altering the angular position of ring 53 and sleeve 52, the minimum separation of cooperating rolls (14A and 14C or 14B and 14D) can be altered, and in this way the dimensions of the rolled square section may be changed or a rectangular section given to the bar. When a roll carrier 12 is adjusted, its ring gear 27 moves tangentially relative to its driving gear 26 but remains in mesh.

The purpose of the inclination of each carrier axis 13 to the roll axis 15 of each roll of the respective carrier will be apparent. If, for example, the carrier axis 13 was parallel to the roll axis, the collars 45A, 45C (FIG. 4) would not diverge away from one another during each rolling operation and would interfere with the divergent faces 50B and 50D of the partially reduced workpiece. By inclining the axes, the collars are caused to follow paths which are similar to the faces 50B, 50D on which the faces 46A, 46C roll. Because the profiles of faces 50A, 50C are similar to the profiles of faces 50B, 50C, the angle $\theta$ between the carrier axis and each roll axis should be about 45°. However because each pair of cooperating rolls (14A and 14C or 14B and 14D) starts and terminates its incremental reduction at points on the workpiece displaced from the corresponding points for the preceding pair of rolls (14B and 14D or 14A and 14C, respectively), the angle is preferably slightly greater than 45°. The actual angle is dependent on workpiece speed, but an angle of 46°20′ has been found suitable.

Although the use of four rolls per roll carrier has been described and illustrated, the number of rolls may be varied according to requirements. For example, six rolls per carrier may be used if a high throughput is required, exemplary maximum throughputs for four rolls per carrier and six rolls per carrier being 100 tonnes per hour and 150 tonnes per hour respectively; the corresponding maximum billet speeds are 0.16 m/second and 0.24 m/second respectively. The maximum reduction obtainable in a single pass by the rolling machine is of the order of 93%.

The rolls 14 are driven about their own axes at speeds relative to the rotational speeds of the carriers such as to promote forward movement to the workpiece 50. The pinch rolls acting on the workpiece are to ensure forward motion, especially during the intervals between rolling by successive pairs of rolls and during the start of rolling.

The reduced rod is metallurgically acceptable because of the absence of sharp lengthwise edges, which would be formed were it not for the collars 45.

The rolling machine described above can be modified in various respects. Thus in the machine described the carrier axes 13 lie in a plane normal to the workpiece passline; instead, one or both pairs of opposite axes (12A and 12C or 12B and 12D) may lie in a plane which is slightly tilted with respect to the plane normal to the passline.

Secondly, the rolls 14 may be made without the collars 45, each roll 14 then being cylindrical and preferably with frusto-conical faces. When collar-less rolls are employed, each roll carrier carries in addition to the rolls 14 an equal number of edger rolls 55 (FIGS. 6 and 7) which may be driven but are preferably undriven and freely rotatable. Each roll 14 is closely followed in the direction of rotation of the carrier 12 by an edger roll 55, as shown in FIG. 6, and each edger roll is so mounted as to roll on a workpiece edge 51 of a face 50A–50D rolled by the preceding roll 14 and has a rolling face 56 (FIG. 7) to round that edge 51. FIG. 7 shows uncollared rolls 14A and 14C at the passline with their respective edger rolls 55A and 55C which roll the rounded edges 51A and 51C (FIG. 4). The figure also shows in chain line the other pair of rolls 14B and 14D when at the passline, but not their edging rolls.

Sections other than square sections can be rolled by the rolling machine by appropriate modification of the profiles of the rolls 14. Thus round sections may be rolled by reducing the curvature of, and increasing the length of, the rounded part 47 of each roll 14 (see FIG. 3). Flats, i.e. sections having a large width compared to their thickness, are rolled with uncollared rolls 14A, 14C having wide faces and uncollared rolls 14B, 14D of smaller face widths (FIG. 8). The carrier axes 13B, 13D are displaced from the positions shown in FIG. 1 so that their minimum separation is as shown substantially larger than the minimum separation of the rolls 14A, 14C. As in FIGS. 6 and 7 each roll 14 is followed by an edging roll 55 to round each edge of the workpiece 50.

Where the rolled workpiece is to have a rectangular section with the width to thickness ratio moderately different from unity, collared rolls may be employed as in FIGS. 1 and 3 to 5, with if necessary alteration of the axial positions of the rolls in order that the collars of those rolls properly follow the workpiece edges. The same considerations apply when rolling oval sections.

I claim:

1. A rolling machine for reducing the cross-sectional dimensions of an elongate workpiece movable lengthwise along a passline, the machine comprising:

(a) a first pair of cooperating rolls between which said workpiece is to be intermittently reduced in a first reduction direction and each of which has a roll axis;

(b) a second pair of cooperating rolls between which said workpiece is intermittently reduced in a second reduction direction transverse to said first direction and each of which has a roll axis;

(c) each said roll having a first rolling face extending substantially parallel to said roll axis and a second rolling face transverse to said roll axis and merging smoothly with said first rolling face;

(d) for each said roll of said first and second pairs, a carrier in which said roll is journalled for rotation about its said roll axis and which is mounted for rotation about a carrier axis inclined to said roll axis, (e) the carrier axes of said carriers for said first pair of rolls being transverse to said passline and on opposite sides thereof;

(f) the carrier axes of said carriers for said second pairs of rolls being transverse both to said passline and to said carrier axes of said carriers for said first pair of rolls and lying on oppsite sides of said passline; and (g) means for synchronously driving all said carriers about said carrier axes;

(h) whereby in each cycle said rolls of each said pair of rolls approach and recede from said passline and each other as said rolls move in the direction of said passline, and said workpiece is intermittently contacted and reduced by said pairs of rolls alternately.

2. A rolling machine as claimed in claim 1 in which said first rolling face of each said roll is cylindrical and said second rolling face is on a collar at one end of said first rolling face.

3. A rolling machine as claimed in claim 1 in which said first rolling face of each said roll is frusto-conical and converges towards the intersection of said roll axis with said carrier axis, and said second rolling face is on a collar at the end of said first rolling face of small diameter.

4. A rolling machine as claimed in claim 1, in which, for rolling round sections, each said roll has rolling surfaces substantially parallel to, and substantially normal to, said roll axis, and a smoothly rounded rolling surface connecting said rolling surfaces.

5. A rolling machine as claimed in claim 1, in which said carrier axis of each said roll carrier intersects at an angle of about 45° the roll axis of the roll carried by that carrier.

6. A rolling machine as claimed in claim 1, further comprising gear means for driving each said roll about its own axis.

7. A rolling machine as claimed in claim 1, in which the axes of said roll carriers lie substantially in a plane at right angles to said workpiece passline.

8. A rolling machine as claimed in claim 1, each roll carrier further comprising at least one further rotatable roll journalled in each said carrier, said further roll, as said roll carrier rotates, cooperating with a similar roll of the said cooperating roll carrier to effect a further reduction of said workpiece.

9. A rolling machine as claimed in claim 5, further comprising at least one further roll journalled in each said carrier and rotatable about an axis which intersects said roll carrier axis at the same point as the first roll axis of the first roll of that carrier and at the same angle, the angular separation of said roll axes about said carrier axis being the same in each said roll carrier.

10. A rolling machine according to claim 9, in which each said roll carrier has three further rolls.

11. A rolling machine as claimed in claim 1, in which the axes of rotation of the four said roll carriers form a square and said drive means include means for coupling together said carriers through gearing.

12. A rolling machine for reducing the cross-sectional dimensions of an elongate workpiece movable along a passline in the direction of its length, the machine comprising:

(a) a frame, (b) four roll carriers each rotatable in said frame about its own carrier axis, the carrier axes of a first and a second of said roll carriers being parallel and lying on opposite sides of said passline, the carrier axes of the third and fourth said roll carriers being at right angles to the axes of said first and second roll carriers and lying on opposite sides of said passline, and all four said roll carrier axes lying substantially in a plane normal to said passline, (c) drive means for rotating said roll carriers in synchronism about said carrier axes, and (d) at least two rolls journalled in each said roll carrier for rotation about independent roll axes which are equally inclined to the roll carrier axis at an angle of about 45°, the angular spacing of said roll axes about said carrier axis being the same in each carrier, (e) each said roll having a rolling surface, a part of which is transverse to the roll axis of that roll, and (f) the arrangement being such that on rotation of said roll carriers said workpiece is successively contacted and reduced between corresponding rolls of the said first and second roll carriers and of said third and fourth roll carriers.

13. A rolling machine for reducing the cross-sectional dimensions of an elongate workpiece movable lengthwise along a passline, the machine comprising:

(a) a first pair of cooperating reducing rolls between which said workpiece is to be intermittently reduced in a first reduction direction and each of which has a roll axis;

(b) a second pair of cooperating reducing rolls between which said workpiece is intermittently reduced in a second reduction direction transverse to said first direction and each of which has a roll axis;

(c) each said roll of said first and second pairs having a cylindrical rolling face;

(d) for each said roll of said first and second pairs, a carrier in which said roll is journalled for rotation about its said roll axis and which is mounted for rotation about a carrier axis inclined to said roll axis;

(e) the carrier axes of said carriers for said first pair of rolls being transverse to said passline and on opposite sides thereof;

(f) the carrier axes of said carriers for said second pair of rolls being transverse both to said passline and to said carrier axes of said carriers for said first pair of rolls and lying on opposite sides of said passline;

(g) an additional edging roll carried by each said roll carrier to round an edge of said workpiece rolled by said reducing roll of said roll carrier; and (h) means for synchronously driving all said carriers about said carrier axes;

(i) whereby in each cycle said reducing rolls of each said pair of rolls approach and recede from said passline and each other as said rolls move in the direction of said passline, said workpiece is intermittently contacted and reduced by said pairs of rolls alternately, and said edging rolls act on said workpiece after each reduction by said reducing rolls.

14. A rolling machine as claimed in claim 13 in which said cylindrical rolling face is frusto-conical and converges towards the intersection of said roll axis with said carrier axis.

15. A rolling machine as claimed in claim 13 in which said carrier axis of each said roll carrier intersects at an angle of about 45° the roll axis of the reducing roll carried by that carrier.

16. A rolling machine as claimed in claim 13 further comprising gear means for driving each said reducing roll about its own axis.

17. A rolling machine as claimed in claim 13 in which the axes of said roll carriers lie substantially in a plane at right angles to said workpiece passline.

18. A rolling machine as claimed in claim 13, each roll carrier further comprising at least one further rotatable reducing roll journalled in each said carrier, said further reducing roll, as said roll carrier rotates, cooperating with a similar reducing roll of said cooperating roll carrier to effect a further reduction of said workpiece.

19. A rolling machine as claimed in claim 15, further comprising at least one further reducing roll journalled in each said carrier and rotatable about a roll axis which intersects said roll carrier axis at the same point as the roll axis of the first reducing roll of that carrier and at the same angle, the angular separation of said roll axes about said carrier axis being the same in each said roll carrier.

20. A rolling machine according to claim 19 in which each said roll carrier has three further reducing rolls.

21. A rolling machine as claimed in claim 13 in which the axes of rotation of the four said roll carriers form a square and said drive means include means for coupling together said carriers through gearing.

* * * * *